US006412652B1

(12) United States Patent
Woram et al.

(10) Patent No.: US 6,412,652 B1
(45) Date of Patent: Jul. 2, 2002

(54) VARIABLE HEIGHT CONTAINER HAVING A DISPLACEABLE ACCESS MEANS FOR THE MATERIALS WITHIN THE CONTAINER

(76) Inventors: Deidre Woram, 12415 English Garden Ct., Oak Hill, VA (US) 20171; Cyndy Allen; Mark Allen, both of 1959 Fiorio Cir., Pleasanton, CA (US) 94566

( * ) Notice: Subject to any disclaimer, the term of this patent is extended or adjusted under 35 U.S.C. 154(b) by 0 days.

(21) Appl. No.: 09/759,834

(22) Filed: Jan. 10, 2001

(51) Int. Cl.[7] ..... B65D 6/12
(52) U.S. Cl. ..... 220/521; 220/524; 220/666
(58) Field of Search ..... 220/503, 505, 220/521, 522, 523, 524, 666, 667

(56) References Cited

U.S. PATENT DOCUMENTS 4,252,236 A 2/1981 Roccaforte
5,199,590 A * 4/1993 Grandahl et al. ..... 220/216
D342,674 S 12/1993 Schollen et al.
5,549,213 A 8/1996 Robbins, III
5,911,338 A 6/1999 Miller
5,957,325 A 9/1999 Montanez
5,971,333 A 10/1999 Fiedor
6,129,687 A * 10/2000 Powell et al. ..... 220/4.07
6,145,681 A * 11/2000 Chimetto et al. ..... 215/384
6,168,041 B1 * 1/2001 Berger et al. ..... 215/382

* cited by examiner

*Primary Examiner*—Joseph M. Moy
(74) *Attorney, Agent, or Firm*—Gregory Scott Smith

(57) ABSTRACT

A collapsible storage container having a displaceable access opening for tracking and providing proximate access to said diapers stored within. Said collapsible container further includes a rigid non-collapsible portion at the top separated into two separate portions, the first portion being the top of said collapsible diaper storage area and the second portion being a discrete independent separate storage area for containing treated or medicated diaper wipes. Said second diaper wipe area having its own separate access area including a hinge and a depression or tab to access the sheets of said diaper wipes.

16 Claims, 4 Drawing Sheets

VARIABLE HEIGHT CONTAINER HAVING A DISPLACEABLE ACCESS MEANS FOR THE MATERIALS WITHIN THE CONTAINER

BACKGROUND OF THE INVENTION

1. Field of the Invention

The present invention relates to adjustable volume and collapsible containers and in particular to an adjustable volume and collapsible container having a displaceable access means for accessing the stored materials within the container.

2. Description of Related Art

Variable height and variable volume containers are well known in the art:

U.S. Pat. No. 5,911,338 is directed to such an adjustable volume container. U.S. Pat. No. 5,911,338 teaches a perimeter side wall that is adjustably extendable to increase or decrease the volume of the interior space. A removable lid is provided.

Design Patent 342,674 is directed to an ornamental design for an expandable container.

U.S. Pat. No. 5,549,213 is directed to a collapsible and reusable container having a resealable cap.

U.S. Pat. No. 4,252,236 is directed to a carton with an opening for a controlled dispensing of materials therein. The opening reveals the entire side of the stack of materials therein and would be useful for grabbing and dispensing the entire stack of materials.

U.S. Pat. No. 5,957,325 is directed to an apparatus having a rectangular frame with an inverted y-shaped partition so as to form two compartments for holding two stacks of diapers each at an incline.

While the variable containers of the above-identified patent references are more or less suitable for their intended purposes, they are not suitable for storing diapers or other materials inside while also having a convenient container for medicated or other suitable wipe sheets to be stored. It is essential to have convenient access to these wipes to be able to clean the diaper area of the baby during a diaper change. As such, an adjustable container such as that disclosed in U.S. Pat. No. 5,911,338 would not be suitable, nor all the other containers of the Relevant Art, because in order to access the contents you must remove the top from the container and set it down in which case the wipe sheets would no longer be at a convenient position for access. Accordingly, it would be desirable to have a variable height/volume container with a non-removable lid that has a displaceable access means for tracking the top height of the materials (such as for example diapers) contained inside and providing access to same.

SUMMARY OF THE INVENTION

Briefly, the present invention is a first variable height adjustable container having a displaceable access means for tracking the variable height of the materials contained within the container and providing access to the same. The container of the invention further includes a second non-adjustable fixed container disposed on the top portion of the variable container, said second fixed container having suitable access openings for both placing wipe sheet materials therein and dispensing therefrom. The variable height container includes four side walls, each having pleated accordion-like longitudinal folds disposed on each of its four rectangular architecture side walls and a rigid side wall portion disposed on the top thereof. Said rigid side wall portion has a rectangular access opening suitable for accessing the contents of the container. The principal purpose of the invention is to hold cloth or disposable diapers within the collapsible portion of the container and the access opening is sized to adequately permit easy removal of the top diaper contained therein. There is a second additional rigid container disposed at the top of the rigid top portion of the variable container, said second rigid container is suitable for storing single-sheet treated diaper wipe sheets for use of an individual changing the diaper of a baby. These diaper wipe sheets are preferably impregnated or otherwise treated with medicinal or convenient lotion materials and therefore require a second fully self-contained hermetically sealed storage container to prevent smearing of the treatment materials. The displaceable access means of the present invention therefore is disposed in the side wall of the variable height container directly below the rigid diaper wipe container and directly above the pleated accordion-like side walls of this variable height container. This positioning of the rectangular access means allows this rectangular access means to be displaceable with the displacement of the variable side walls of the variable container and further allows it to constantly track the decreasing height of the diapers or other materials contained therein so as to provide convenient access to the user of the top portion of the diaper or other materials contained therein. Loading of both the diaper wipe sheets and the diapers themselves are provided by two hinges disposed in the side of the rigid top portion of said variable container so as to provide access both to the first lower variable height container and the second upper rigid container. Said containing means further includes rigid access tabs disposed upon the opposite side wall from the flexible hinges so as to provide ease of opening both the top rigid container and the bottom variable height container for placing suitable contents therein. The rigid diaper wipe container on the top further includes either an indentation or a protruding tab disposed in its uppermost surface and a third lid having an opposing flexible hinge from the indentation or protruding tab. The indentation or protruding tab allowing opening of the third access opening so as to provide ease of access to the diaper wipe sheets contained therein. The first variable height container and the second fixed upper container may be formed as a unitary or separate construction without departing from the teachings of the invention.

BRIEF DESCRIPTION OF THE DRAWINGS

The invention may be understood and further advantages and uses thereof more readily apparent, when considered in view of the following detailed description of the exemplary embodiments, taken with the accompanying drawings, in which.

DESCRIPTION OF THE PREFERRED EMBODIMENTS

Figure 1:
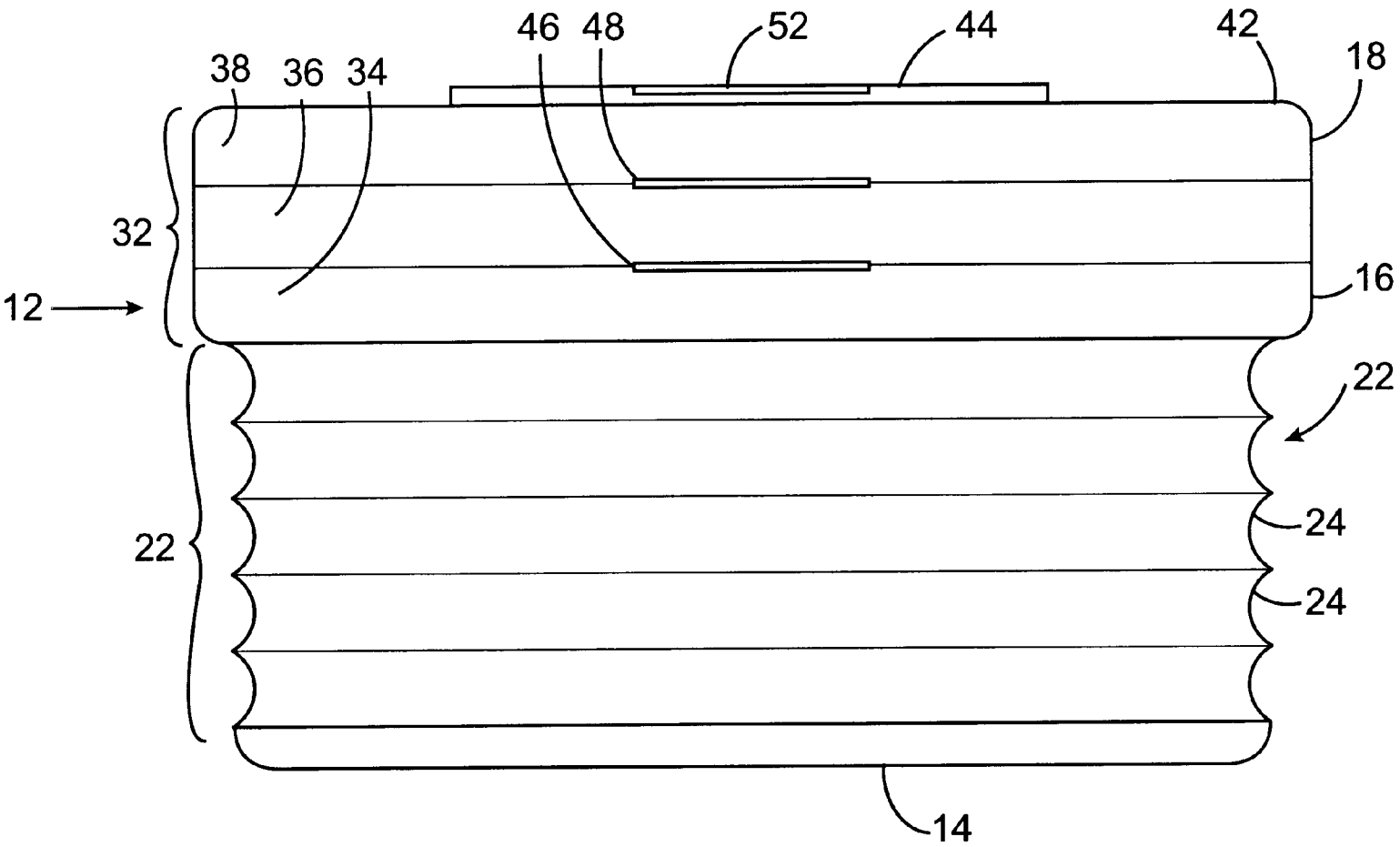
FIG. 1 is a front view of the present variable container invention constructed according to the teachings of the invention, illustrating the pleated accordion-like side wall of the variable container as well as the rigid container portion disposed on top thereof.
Figure 4:
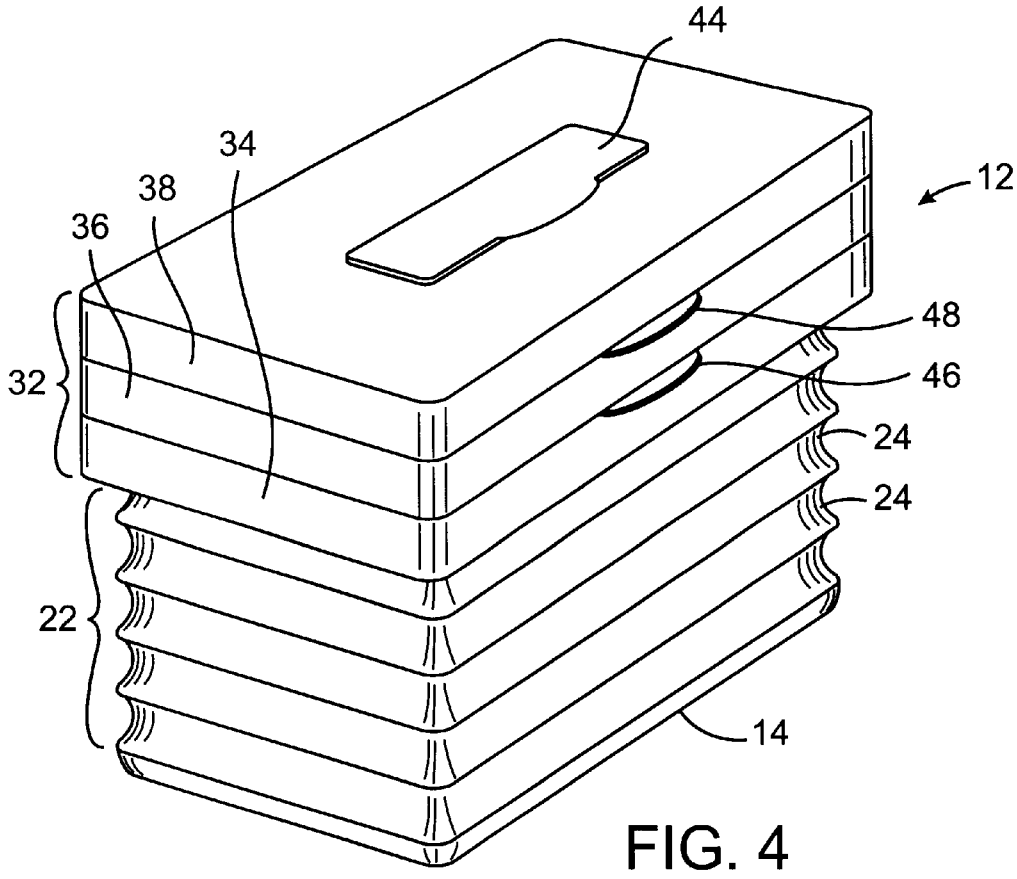
FIG. 4 is a perspective view of an embodiment of the invention shown with the variable volume chamber of the invention in an extended condition.
Figure 5:
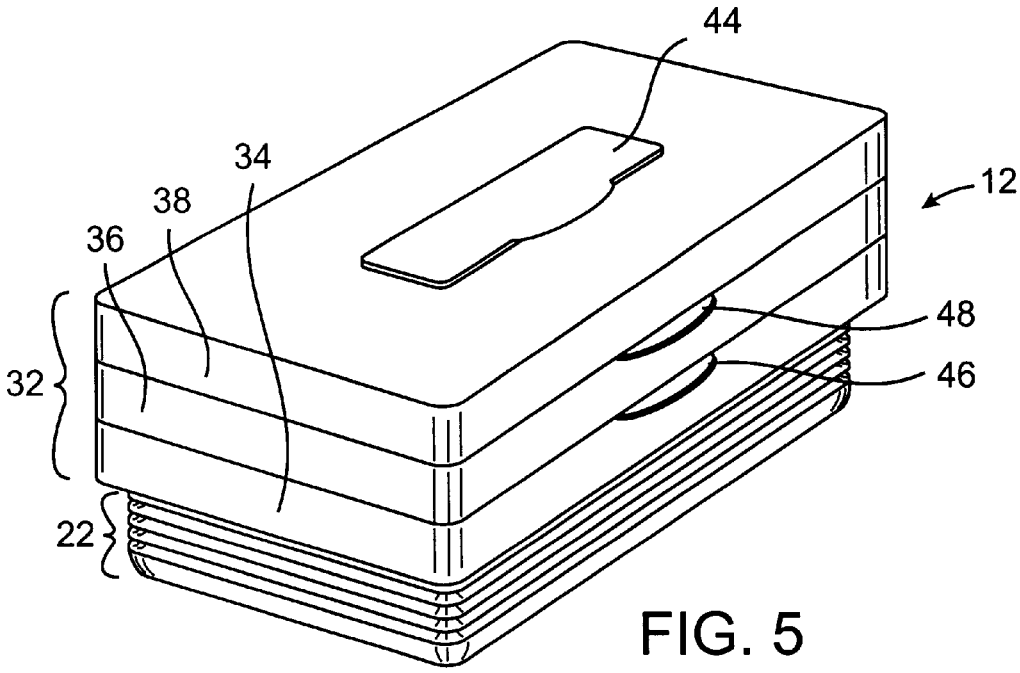
FIG. 5 is a perspective view of an embodiment of the invention shown with the variable volume chamber of the invention in a collapsed condition.

Referring now to FIG. 1, there is shown a front elevational view of the adjustable collapsible container 12 constructed according to the teachings of the invention. Adjustable height container 12 includes base 14 and an adjustable height perimeter side wall 16 disposed around the base 14 to define an interior space where a storable material such as for instance a diaper may be placed. The perimeter side wall 16 has an adjustable height H defined as extending between the top portion 18 of perimeter side wall 16 and the bottom of the container 14. This height H is fully adjustable and extendable to increase or decrease the interior volume of the interior space defined by perimeter side wall 16. The adjustable extension of perimeter side wall 16 is permitted because side wall 16 has disposed thereon a pleated portion 22 extending around it. This pleated portion 22 has a plurality of longitudinal folds that are arranged in an accordion fashion between bottom 14 and top 18 of perimeter side wall 16. Any acceptable material may be used for pleated portion 22, however, preferably the material will be flexible but characterized by having a tendency to return to the folded configuration when expanded, easily cleaned, and water resistant. FIG. 4 shows a perspective view of an embodiment of the container 12 with the variable volume chamber of the invention in an extended condition. FIG. 5 is a perspective view of an embodiment of the container 12 shown with the variable volume chamber of the invention in a collapsed condition.

Top portion 32 of perimeter side wall 16 is made of a rigid non-extendable material and is divided into three separate top portions, 34, 36 and 38 respectively. First top portion 34 is simply a rigid area used as the top of the extendable pliable pleated area 22 and is used both to store materials therein and as will be explained later, is used as a dispensing area for the user to obtain materials out of the extendable storage container below. Second top portion 36 is a rigid container that is used to store the pliable treated diaper wipes therein. Third top portion 38 is also used as a storage area for treated diaper wipes and also as will be shown later is used as an area in which to access and from which to retrieve diaper wipes (at the top 42 of container 12 there is disposed a hinged access door 44 which allow access to the treated diaper wipe sheet material). The non expandable portions of the container 12 maybe made of virtually any acceptable material, however, a tough plastic material is preferred. Both first and second top portions 34 and 36 have a rigid finger leverage tab 46 and 48 respectively which are used for leveraging open the first and second top portions of adjustable container 12. In addition, top hinged access door 44 includes a rigid opening tab 52 which again is used for prying open top hinged access door 44 in order to retrieve the treated sheet wipe material. In some embodiments it is preferred that the container 12 include a carrying means such as a strap or handle.

Figure 2:
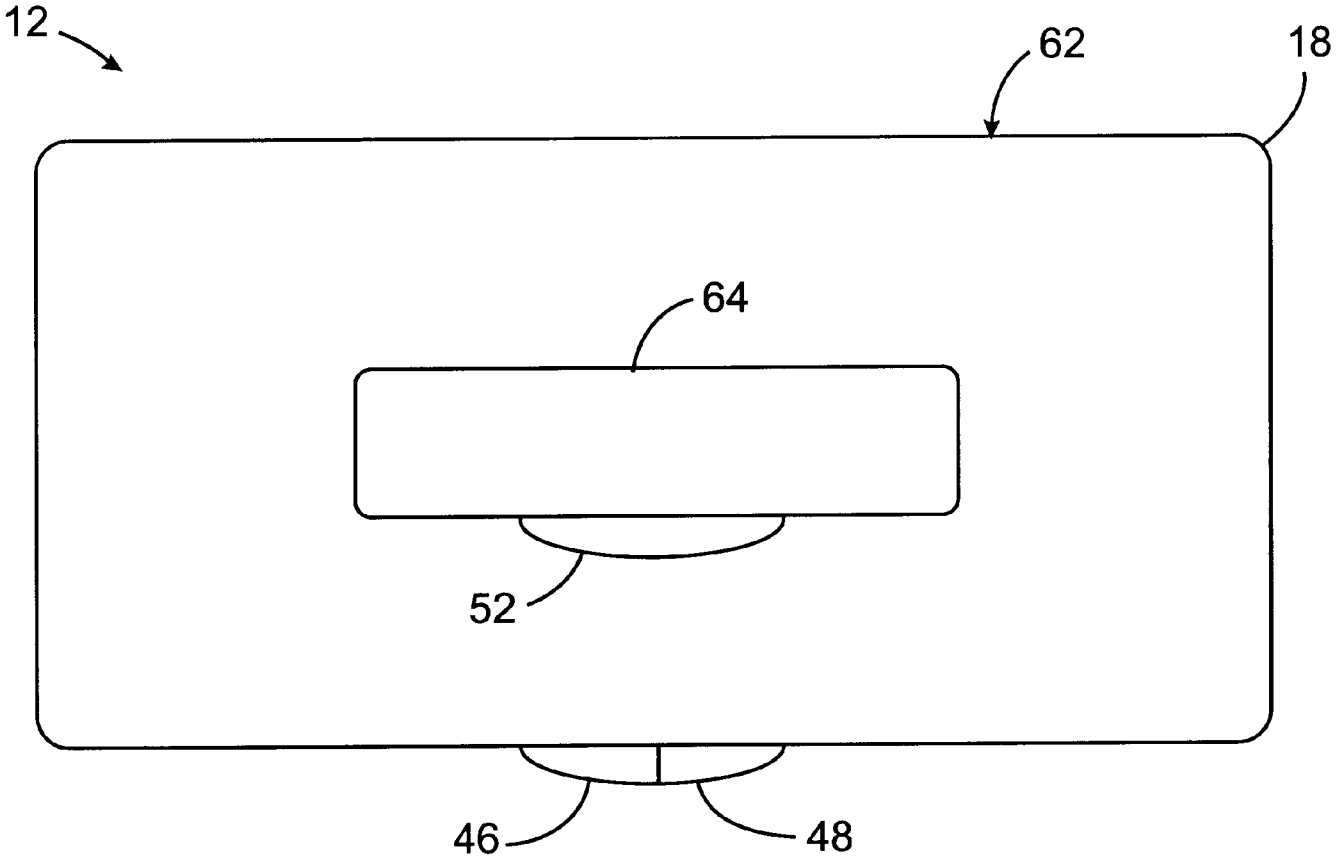
FIG. 2 is a top view of the variable container constructed according to the teachings of the invention shown in FIG. 1 illustrating a small rectangular hinged top portion for access to the rigid container disposed on top.

Referring now to FIG. 2, there is shown a top view of adjustable container 12 showing the top portion 18 of perimeter side wall 16 and showing in particular both first and second tab members 46 and 48 and tab member 52 which are used for opening adjustable container 12. In addition, there is shown back hinge 62 and top hinge 64 which are used for opening hinged access door 44 and second top portion 38 of adjustable container 12, respectively.

Figure 3:
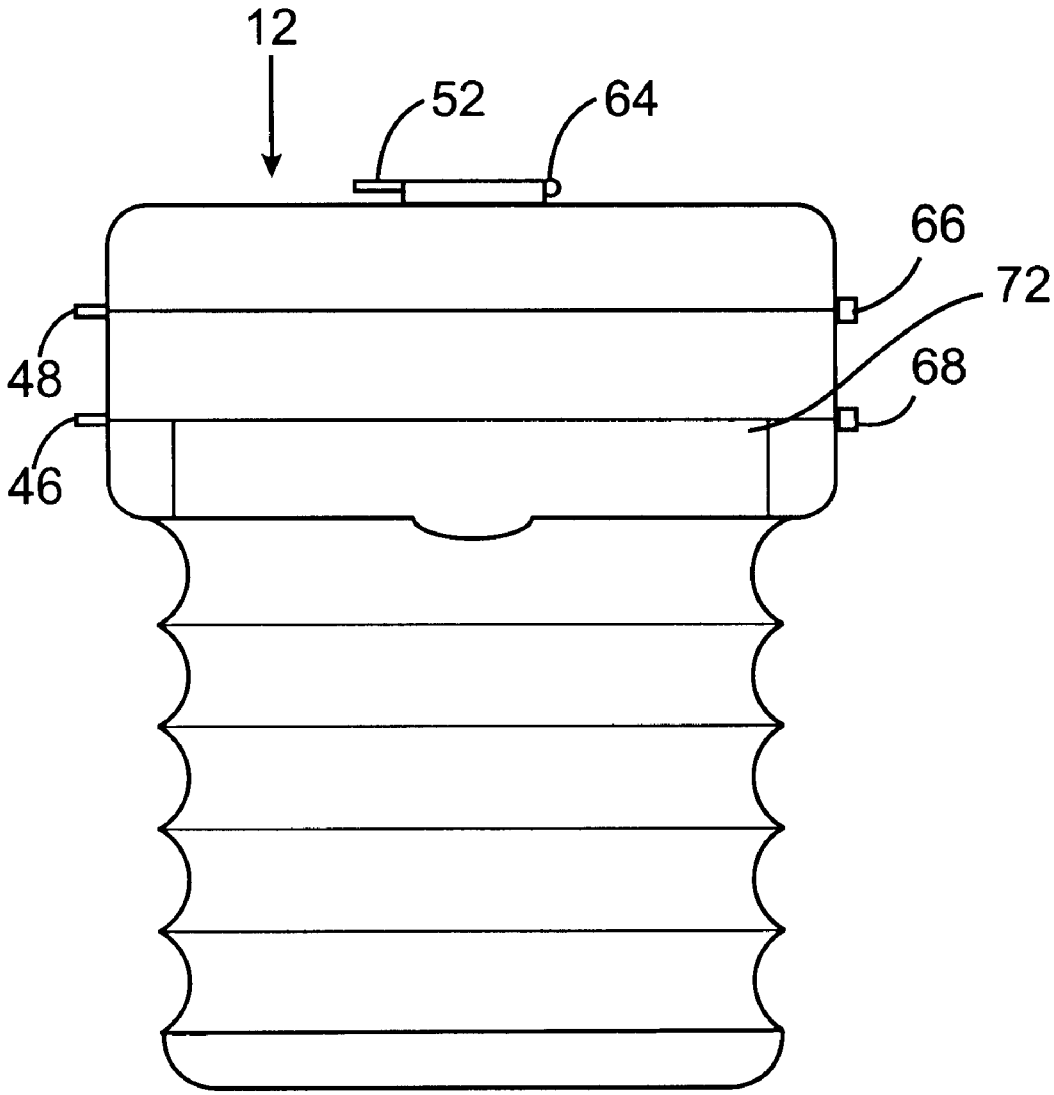
FIG. 3 is a side view of the variable height container constructed according to the teachings of the invention further illustrating both a displaceable access means that tracks the variable height of the container and provides access to the materials contained therein as well as three flexible hinges and three rigid opening tabs or levers for opening both the variable height container portion on the bottom, the rigid diaper wipe container portion on the top, and a third rectangular hinged portion at the very top for providing access to the diaper wipe materials therein.

Referring now to FIG. 3, there is shown an elevational side view of expandable adjustable container 12 illustrating in particular displaceable access opening 72 which access opening 72 is displaceable to follow the collapse of adjustable container 12 as the amount of diapers contained inside is depleted such that displaceable and accessible access opening 72 is always proximate the location of the top diaper of the stored diapers. FIG. 3 further illustrates once again opening tabs 46 and 48 and 52 as well as back hinges 64, 66 and 68 respectively.

In operation first lift tab 46 is used to open up the adjustable bottom portion of container 12 wherein the diapers can be loaded therein. Second rigid tab 48 can be used to open the second portion of the rigid top portion of adjustable container 12 to load the wipe sheets therein. Rigid tab 52 can be used to open the top hinged access door 44 in order to pull out the wipe sheets for use in dressing and cleaning the baby during a diaper change. As diapers are removed from displaceable access opening 72 the adjustable portion 22 of side wall 16 will naturally decrease in height due to the weight of diaper wipe sheets contained in upper storage area 32 or otherwise by the user pressing down on upper storage area 32. As the displaceable access opening 72 decreases in height H along with the side wall portion 22 of side wall perimeter 16 then the uppermost diaper is always accessible to the fingertips of the user. Displaceable access means 72 not only tracks the height of the stored material such as stored diapers, but displaceable access means 72 also maintains proximate relationship to the side of the uppermost or topmost stored material within collapsible storage container 12. Keeping this proximate access to the top material makes collapsible storage container 12 workable for always being able to access or dispense the top diaper through rectangular access opening 72. Access opening 72 only has to be designed to the correct opening width for whatever size diaper or other material is stored inside collapsible container 12.

With respect to the sizes of the materials such as for instance diapers that are to be stored within expandable container 12, it is to be understood that the optimal dimensional relationships for the side walls and other parts of the above described collapsible storage means 12 includes variations in sizes and materials that would lend collapsible storage means 12 to its intended use. Although not to be limited hereto, the following sizes and materials are found to be optimized for multiple sized diapers such as newborn through adult: the container should preferably define an area approximately 5 inches by 8 inches for babies below 2 years of age, approximately 5 inches by 10 inches for children 2 to 3 years of age, and the container preferably define an area approximately 8 inches by 10 inches to accommodate geriatric or adult diaper sizes. Although not to be limited hereto, it is preferred that the volume of the container be sufficient to hold at least 4–5 diapers of the appropriate size.

We claim:

1. A collapsible container having at least one displaceable access opening, comprising:

a base and perimeter walls disposed about said base so as to define an interior space, said perimeter walls having at least one variable pleated portion extending along said perimeter side walls such that the height of said container is adjustably extendable;

a rigid side wall top portion being divided into at least two storage areas, said first storage area being the top of said collapsible perimeter side wall, said second storage area being an independent separate storage area which may be used for storing a different type of material than said first variable storage area underneath; and dispensing means disposed on the top side of said second rigid separable independent and discrete storage area for access to the materials stored therein.

2. The collapsible container having at least one displaceable access opening, comprising a base and perimeter walls disposed about said base so as to define an interior space, said perimeter wall having a pleated portion extending along said perimeter side walls such that the height of said container is adjustably extendable of claim 1, wherein said perimeter side wall has a rigid side wall portion and further includes a rectangular opening disposed within the rigid side walls at the top of the variable side wall to provide a displaceable access opening to the materials stored within said collapsible container.

3. The collapsible container having at least one displaceable access opening, comprising a base and perimeter walls disposed about said base so as to define an interior space, said perimeter wall having a pleated portion extending along said perimeter side walls such that the height of said container is adjustably extendable of claim 2, wherein said stored materials are diapers and diaper wipes respectively.

4. The collapsible container having at least one displaceable access opening, comprising a base and perimeter walls disposed about said base so as to define an interior space, said perimeter wall having a pleated portion extending along said perimeter side walls such that the height of said container is adjustably extendable of claim 3, wherein said displaceable access opening has a rectangular periphery suitable for reaching in and extracting a diaper from the collapsible storage area.

5. The collapsible container having at least one displaceable access opening, comprising a base and perimeter walls disposed about said base so as to define an interior space, said perimeter wall having a pleated portion extending along said perimeter side walls such that the height of said container is adjustably extendable of claim 4, further including first, second and third access tabs and first, second and third opposingly disposed pliable hinges so as to provide for three openings in said collapsible storage container, said first opening being disposed at the top of the collapsible storage area, said second opening being disposed on top of the first opening and said third opening being disposed on top of said second opening.

6. The collapsible container having at least one displaceable access opening, comprising a base and perimeter walls disposed about said base so as to define an interior space, said perimeter wall having a pleated portion extending along said perimeter side walls such that the height of said container is adjustably extendable of claim 5, further including an intermediate floor disposed within said perimeter wall above said pleated portion and below said second opening to define a second interior space within said collapsible container.

7. A collapsible container comprising:

A housing including a first chamber and a second chamber, the first chamber having an adjustable volume being defined by a top wall, a bottom wall, and side walls, with each side wall including a pleated portion, an first opening proximate the top wall of the first chamber A second chamber defined by a top wall, a bottom wall, and side walls, a first closeable opening formed in the second chamber including.

8. The collapsible container of claim 7, wherein the housing further includes a third chamber.

9. The collapsible container of claim 7, wherein the bottom wall of the first chamber is moveable relative to the top wall of the first chamber.

10. The collapsible container of claim 7, wherein the first chamber is configured for holding diapers.

11. The collapsible container of claim 7, wherein the second chamber is configured for holding diaper wipes.

12. The collapsible container of claim 7, further including a second opening in the first chamber for filling the first chamber, the second opening in the first chamber being closeable.

13. The collapsible container of claim 7, further including a second opening in the second chamber for filling the second chamber, the second opening in the second chamber being closeable.

14. The collapsible container of claim 7, wherein the first opening in the first chamber is located in a non-pleated portion of a side wall.

15. The collapsible container of claim 7, wherein the pleated portion of each side wall comprises substantially all of each side wall.

16. The collapsible container of claim 7, wherein the pleated side walls of the first chamber include a collapsed configuration, and tend to return to the collapsed configuration when moved from the collapsed configuration to an expanded configuration.

* * * * *